US010188914B2

(12) United States Patent
Narita et al.

(10) Patent No.: US 10,188,914 B2
(45) Date of Patent: Jan. 29, 2019

(54) GOLF CLUB HEAD

(71) Applicant: Bridgestone Sports Co., Ltd., Tokyo (JP)

(72) Inventors: Tadahiro Narita, Yokohama (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/251,044

(22) Filed: Aug. 30, 2016

(65) Prior Publication Data

US 2017/0128790 A1 May 11, 2017

(30) Foreign Application Priority Data

Nov. 6, 2015 (JP) ..... 2015-218750

(51) Int. Cl.
*A63B 53/04* (2015.01)

(52) U.S. Cl.
CPC ..... *A63B 53/0466* (2013.01); *A63B 2225/01* (2013.01)

(58) Field of Classification Search
CPC ..... A63B 53/0466
See application file for complete search history.

(56) References Cited

U.S. PATENT DOCUMENTS 5,092,599 A * 3/1992 Okumoto ..... A63B 53/04 473/327
5,511,786 A * 4/1996 Antonious ..... A63B 53/04 473/327
6,168,537 B1 * 1/2001 Ezawa ..... A63B 53/04 473/327
8,777,773 B2 7/2014 Burnett et al.
2003/0220154 A1 11/2003 Anelli
2010/0016095 A1 * 1/2010 Burnett ..... A63B 53/0466 473/327
2013/0324293 A1 * 12/2013 Stites ..... A63B 53/0466 473/327
2014/0087893 A1 * 3/2014 Henrikson ..... A63B 53/0466 473/327

FOREIGN PATENT DOCUMENTS

JP 3-114477 A 5/1991
JP 2000-176057 A 6/2000

* cited by examiner

*Primary Examiner* — Michael Dennis
(74) *Attorney, Agent, or Firm* — Sughrue Mion, PLLC

(57) ABSTRACT

A golf club head includes a crown portion and a face portion. The crown portion includes a first protruding portion arranged on the side of the face portion, and a second protruding portion arranged on the back side to be adjacent to the first protruding portion. The width of the first protruding portion in the face-back direction on a plane passing through the face center of the face portion and extending in the vertical direction is smaller than the width of the second protruding portion in the face-back direction. The protruding height of the second protruding portion is larger than the protruding height of the first protruding portion.

11 Claims, 5 Drawing Sheets

GOLF CLUB HEAD

BACKGROUND OF THE INVENTION

Field of the Invention

The present invention relates to a golf club head.

Description of the Related Art

Measures for exerting an influence on an air current flowing to a golf club head have been proposed (Japanese Patent Laid-Open No. 2000-176057, Japanese Patent Laid-Open No. 03-114477, U.S. Patent Application Publication No. 2003/220154, and U.S. Pat. No. 8,777,773).

The shape of a golf club head may affect an air current flowing to the golf club head and degrade the air resistance. If the air resistance increases, the head speed lowers, and the distance performance of the golf club head deteriorates.

SUMMARY OF THE INVENTION

It is an object of the present invention to reduce the air resistance to a golf club head.

According to an aspect of the present invention, there is provided a golf club head comprising a crown portion and a face portion, wherein the crown portion includes a first protruding portion arranged on a side of the face portion, and a second protruding portion arranged on a back side to be adjacent to the first protruding portion, a width of the first protruding portion in a face-back direction on a plane passing through a face center of the face portion and extending in a vertical direction is smaller than a width of the second protruding portion in the face-back direction, and a protruding height of the second protruding portion is larger than a protruding height of the first protruding portion.

Further features of the present invention will become apparent from the following description of exemplary embodiments (with reference to the attached drawings).

DESCRIPTION OF THE EMBODIMENTS

Figure 1:
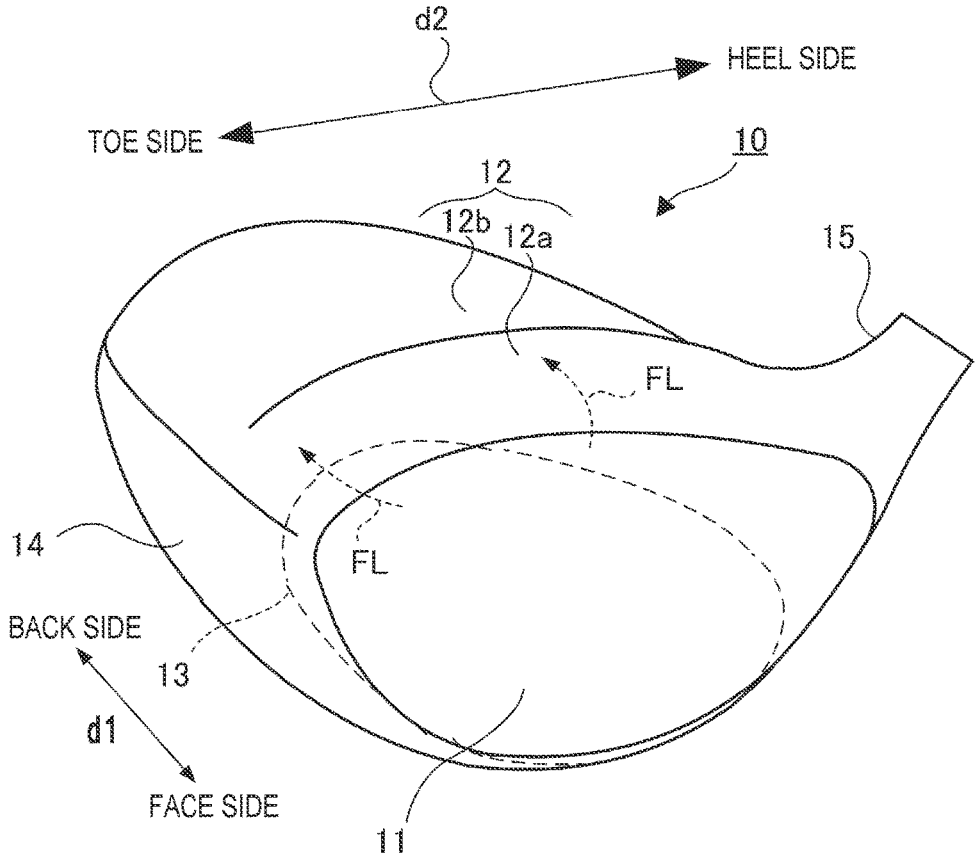
FIG. 1 is a perspective view of a golf club head according to an embodiment of the present invention.
Figure 2:
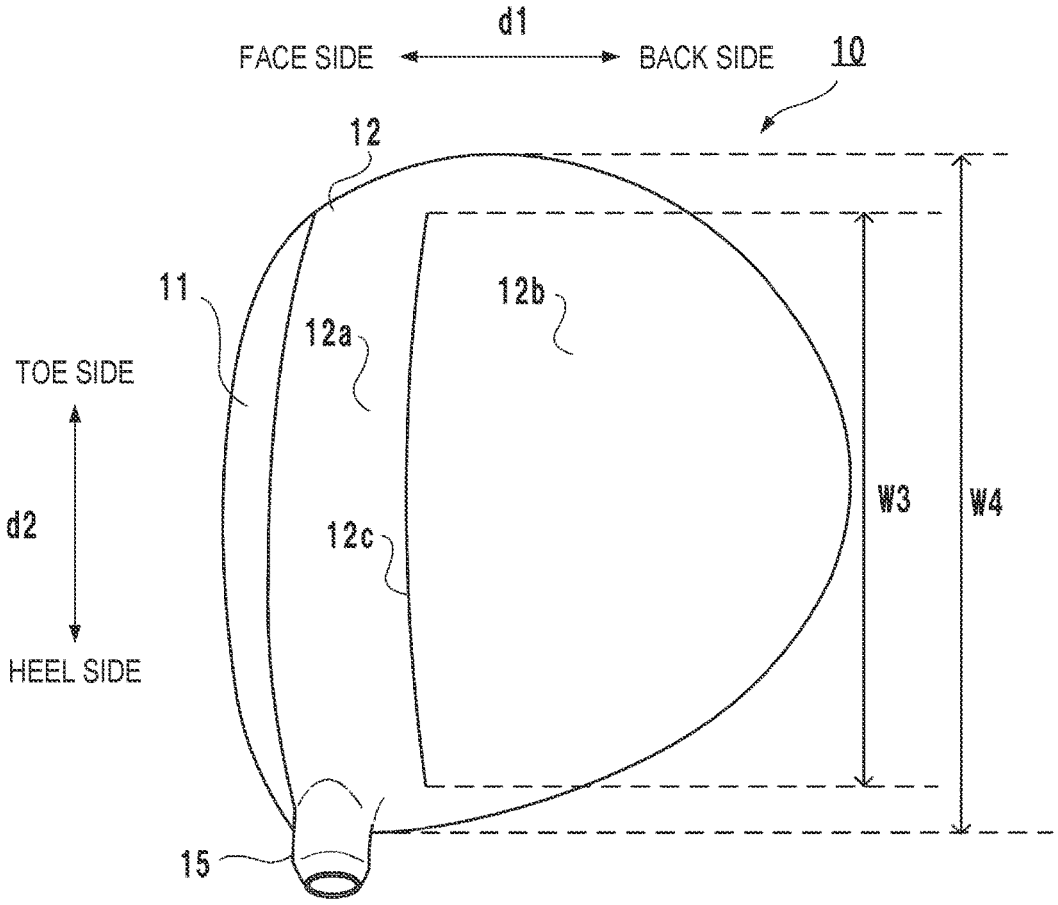
FIG. 2 is a view showing the golf club head in FIG. 1 viewed from above.
Figure 3A:
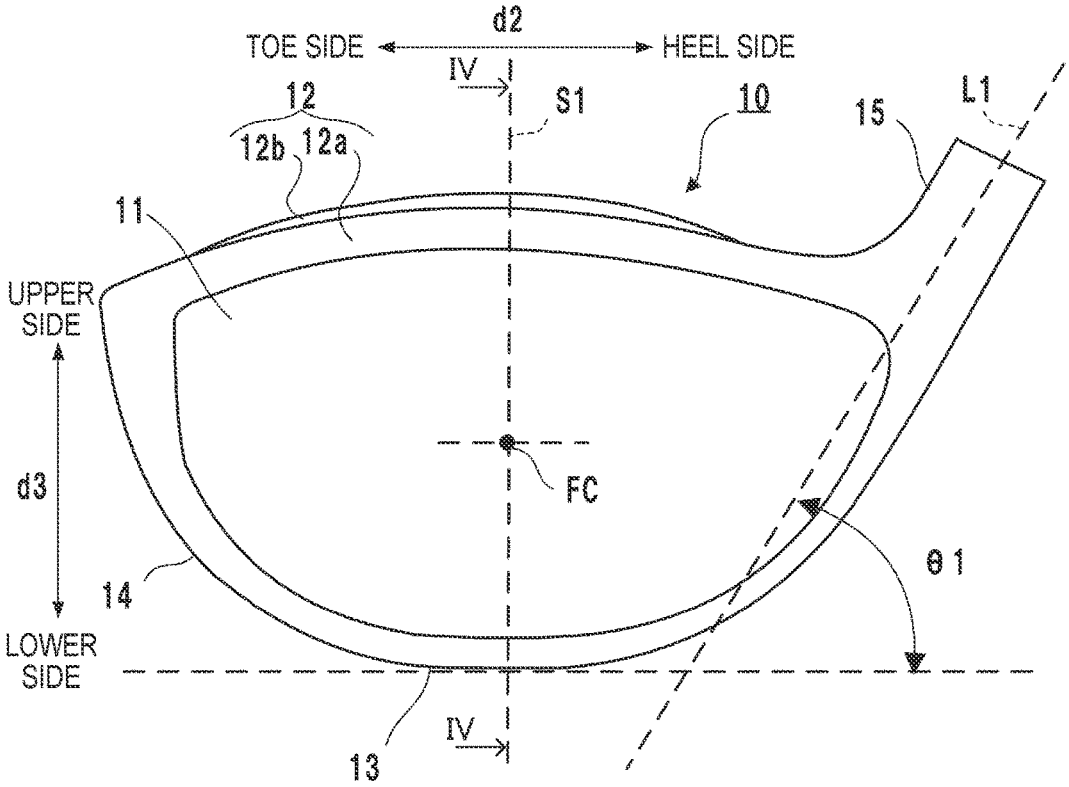
FIG. 3A is a view showing the golf club head in FIG. 1 viewed from a face side.
Figure 3B:
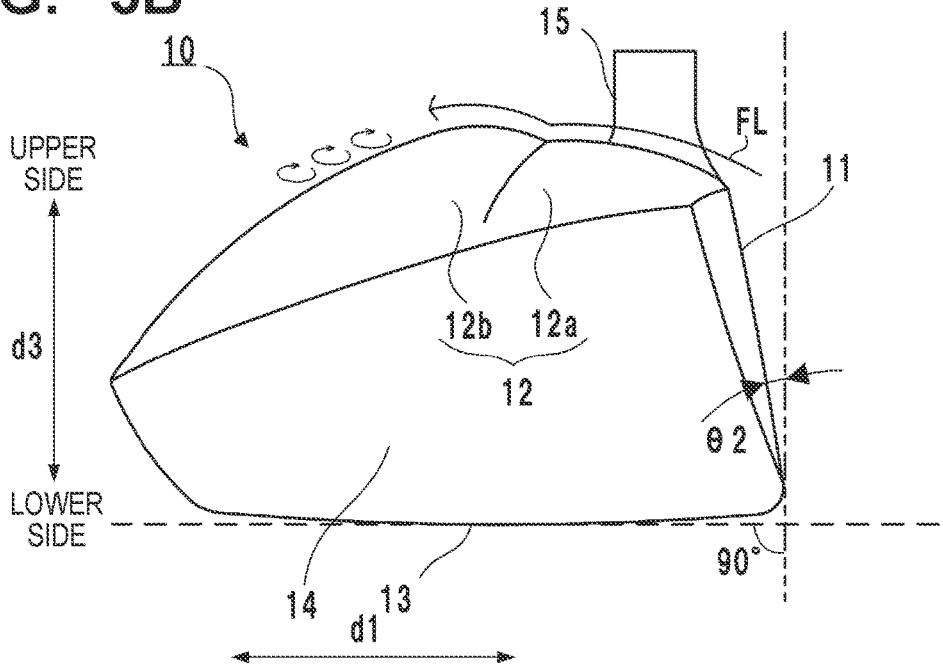
FIG. 3B is a view showing the golf club head in FIG. 1 viewed from a toe side.

FIG. 1 is a perspective view showing a golf club head 10 according to an embodiment of the present invention which is viewed from a face side. FIG. 2 is a plan view showing the golf club head 10 viewed from above. FIG. 3A is a front view showing the golf club head 10 viewed from the face side. FIG. 3B is a side view showing the golf club head 10 viewed from a toe side. FIGS. 3A and 3B are views in a case in which the golf club head 10 is grounded in accordance with a predetermined lie angle θ1 and a predetermined loft angle θ2 (also called a reference posture).

The golf club head 10 forms a hollow body, and includes a face portion 11 that forms a face (striking face), a crown portion 12 that forms the upper portion of the golf club head 10, and a sole portion 13 that forms the bottom portion of the golf club head 10. The golf club head 10 also includes a side portion 14 between the crown portion 12 and the sole portion 13, which forms the peripheral wall of the golf club head 10. The side portion 14 includes a toe-side portion, a heel-side portion, and a back-side portion. The golf club head 10 also includes a hosel portion 15 in which a shaft is inserted and fixed.

The crown portion 12 includes a first protruding portion 12*a* and a second protruding portion 12*b* (to be described later) as air resistance reducing elements. The first protruding portion 12*a* is arranged on the crown portion 12 on the side of the face portion 11. The second protruding portion 12*b* is arranged on the back side of the crown portion 12 to be adjacent to the first protruding portion 12*a*.

Referring to the drawings, an arrow d1 indicates a face-back direction, an arrow d2 indicates a toe-heel direction, and an arrow d3 indicates a vertical direction. The face-back direction is normally a target line direction (the target direction of a shot). The toe-heel direction can be defined as, for example, a direction in which the toe-side end and the heel-side end of the sole portion 13 are connected or a direction perpendicular to the face-back direction.

The golf club head 10 is a golf club head for a driver. However, the present invention is applicable to various kinds of golf club heads such as a wood type golf club head including a fairway wood other than drivers, a utility (hybrid) golf club head, and other golf club heads.

The golf club head 10 can be made of a metal material. Examples of the metal material are a titanium-based metal (for example, titanium alloy 6Al-4V-Ti), stainless steel, and a copper alloy such as beryllium copper.

<Face Center>

Figure 4A:
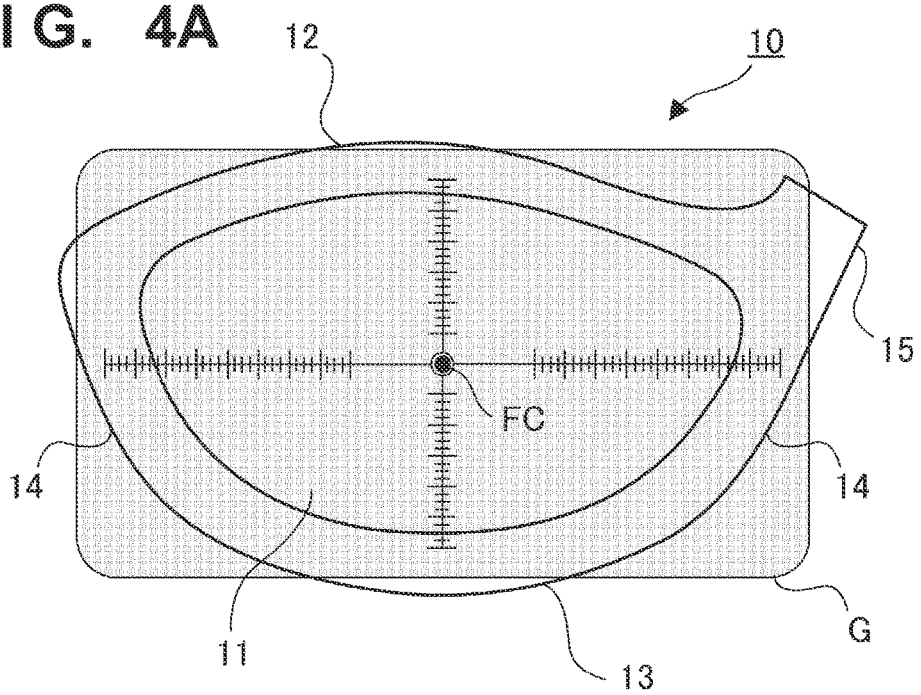
FIG. 4A is an explanatory view of a face center.

A face center will be described with reference to FIG. 4A. As shown in FIG. 4A, a gauge G with vertical and horizontal scales is put to the face portion 11, and the center point of the vertical and horizontal scales is defined as a face center FC. The gauge G is a thin transparent plate with a hole formed at the intersection of the vertical and horizontal scales. The same plate as a so-called impact point template can be used. The impact point template is a template used to specify the face center when measuring the CT value of the face portion.

<Protruding Portion>

Figure 4B:
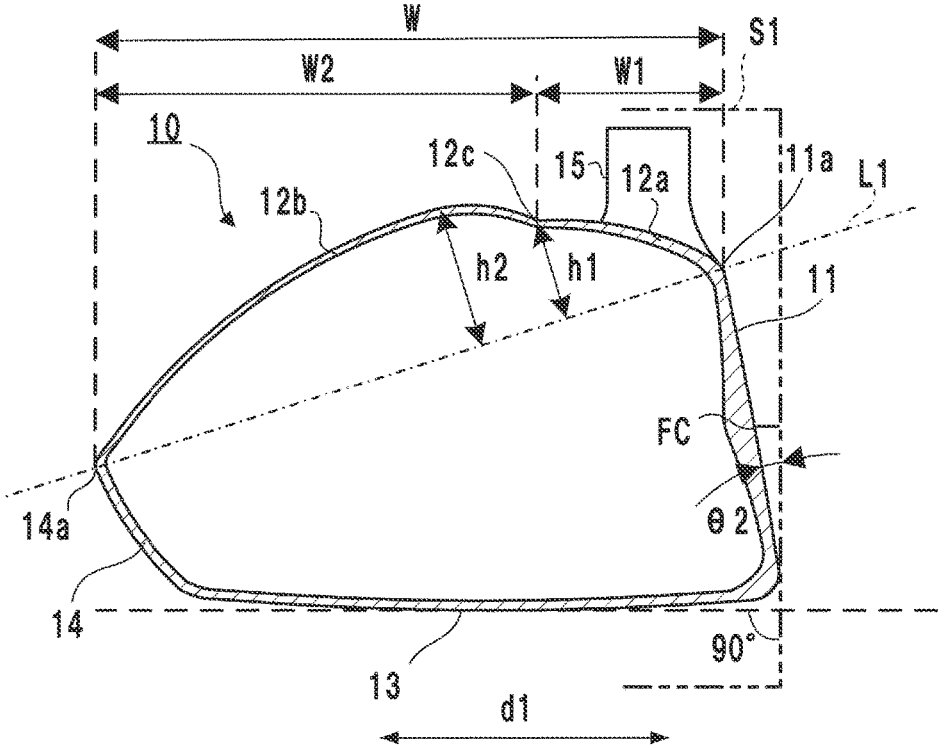
FIG. 4B is a sectional view taken along a line IV-IV in FIG. 3A.

FIG. 4B is a sectional view (a sectional view taken along a line IV-IV in FIG. 3A) of the golf club head 10 taken along a plane S1 passing through the face center FC of the face portion 11 and extending in the vertical direction in the reference posture. The first protruding portion 12*a* has one end in the face-back direction d1 connected to an upper end 11*a* of the face portion 11 and the other end connected to the second protruding portion 12*b* at a connection portion (or boundary line) 12*c*, and protrudes upward. The second protruding portion 12*b* has one end in the face-back direction d1 connected to the first protruding portion 12*a* at the connection portion 12*c* and the other end connected to an upper end 14*a* of the side portion 14 on the back side, and protrudes upward.

In the reference posture, a width W1 of the first protruding portion 12*a* in the face-back direction d1 on the plane S1 is defined as the width from the upper end 11*a* of the face portion 11 to the connection portion 12*c*. A width W2 of the second protruding portion 12*b* in the face-back direction d1 is defined as the width from the connection portion 12*c* to the upper end 14*a* of the side portion 14. At this time, the width W1 of the first protruding portion 12*a* is set to be smaller than the width W2 of the second protruding portion 12*b*. With this structure, an air current (to be described later) passing on the crown portion 12 can easily move along the crown portion 12, and the separation position of the air current can be moved to the back side. The width W1 of the first protruding portion 12*a* in the face-back direction d1 may be 20% (inclusive) to 40% (inclusive) of a width W of the entire crown portion 12 of the head 10.

The protruding heights of the first protruding portion 12*a* and the second protruding portion 12*b* will be described with reference to FIGS. 3A and 4B. In this embodiment, the protruding heights are the heights of the protruding portions 12*a* and 12*b* extending vertically upward to the outside of the head 10 with respect to a line L1 that connects the upper end 11*a* of the face portion 11 as the start point of the first protruding portion 12*a* to the upper end 14*a* of the side portion 14 as the end point of the second protruding portion 12*b*, as shown in FIG. 4B.

In FIG. 4B, the maximum value of the protruding height of the first protruding portion 12*a* is represented by a maximum height h1, and the maximum value of the protruding height of the second protruding portion 12*b* is represented by a maximum height h2. Note that in this embodiment, the maximum height h1 of the first protruding portion 12*a* is the protruding height at the connection portion 12*c*. The maximum height h2 of the second protruding portion 12*b* is the protruding height at a portion shifted from the connection portion 12*c* to the back side by a predetermined distance. That is, the protruding height of the second protruding portion 12*b* from the upper end 11*a* of the face portion 11 is set to be larger than the protruding height of the first protruding portion 12*a*.

In this embodiment, the protruding height of the first protruding portion 12*a* gradually increases from the upper end 11*a* of the face portion 11 to the connection portion 12*c*. The protruding height of the second protruding portion 12*b* gradually increases from the connection portion 12*c* to a position on the back side where the protruding height has the maximum value, and then gradually decreases up to the upper end 14*a* of the side portion 14 on the back side. Note that the maximum value of the protruding height of the first protruding portion 12*a* need not always be set at the connection portion 12*c* and may be set on the face side with respect to the connection portion 12*c*.

Note that as shown in FIG. 3A, the first protruding portion 12*a* and the second protruding portion 12*b* are arranged to extend in the toe-heel direction d2 perpendicular to the plane S1 passing through the face center FC. As shown in FIG. 2, for example, a width W3 (the width of the first protruding portion 12*a*) to arrange the connection portion 12*c* between the first protruding portion 12*a* and the second protruding portion 12*b* in the toe-heel direction may be 50% (inclusive) to 100% (inclusive) of a width W4 of the entire head 10.

<Flow of Air Current>

FIG. 3B shows a flow FL of an air current passing on the crown portion 12 on the side view of the head 10. Since the protruding height of the second protruding portion 12*b* is larger than the protruding height of the first protruding portion 12*a*, the flow FL of the air current that enters from the side of the face portion 11 passes on the first protruding portion 12*a* and hits the second protruding portion 12*b*. The air current can further flow along the crown portion 12 up to the position where the protruding height of the second protruding portion 12*b* is maximized. Separation of the flow FL of the air current is observed on the crown portion 12 on the back side with respect to the position where the protruding height of the second protruding portion 12*b* is maximized.

Figure 5A:
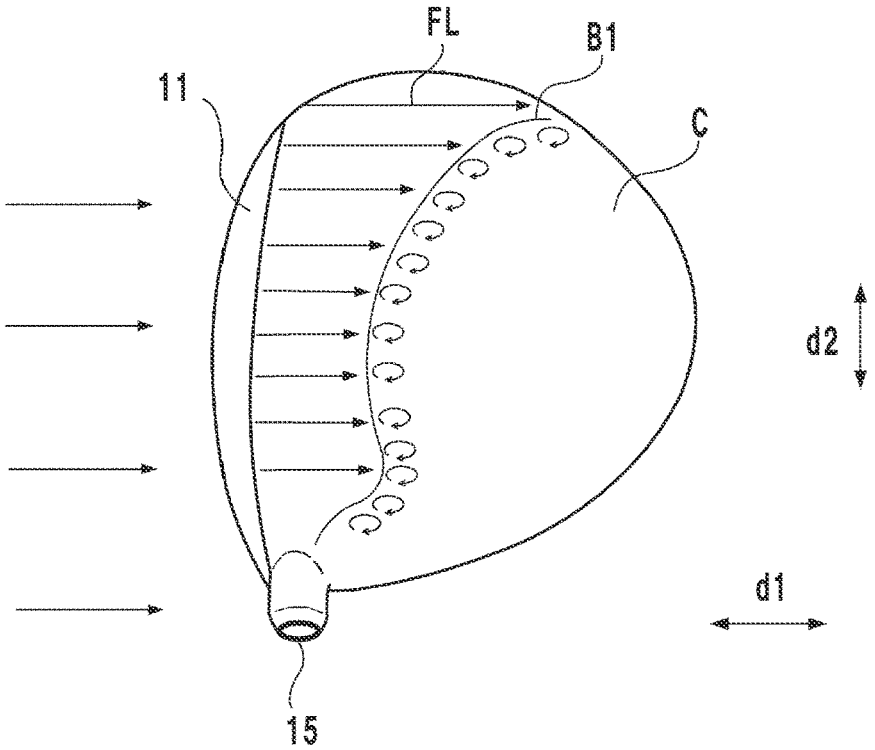
FIG. 5A PRIOR ART
FIGS. 5A and 5B are explanatory views of an air current.

As the results of simulations on a computer, the flow and the separation position of an air current on the crown portion in each of the embodiment and a conventional technique will be described here with reference to FIGS. 5A and 5B. FIG. 5A shows an example of a conventional golf club head that has the same arrangement as the golf club head 10 except that the first and second protruding portions are not provided. FIG. 5A is an explanatory view showing the relationship between the flow FL and the separation position of an air current on a conventional crown portion C. A position where separation starts on the conventional crown portion C is indicated by a solid line B1. As shown in FIG. 5A, immediately before an impact, the air current to the golf club head 10 flows in the face-back direction. The air current flowing on the surface of the crown portion C changes to a laminar flow on the side of the face portion 11 and separates halfway. The earlier the separation of the air current starts, the larger the air resistance to the golf club head 10 is.

Figure 5B:
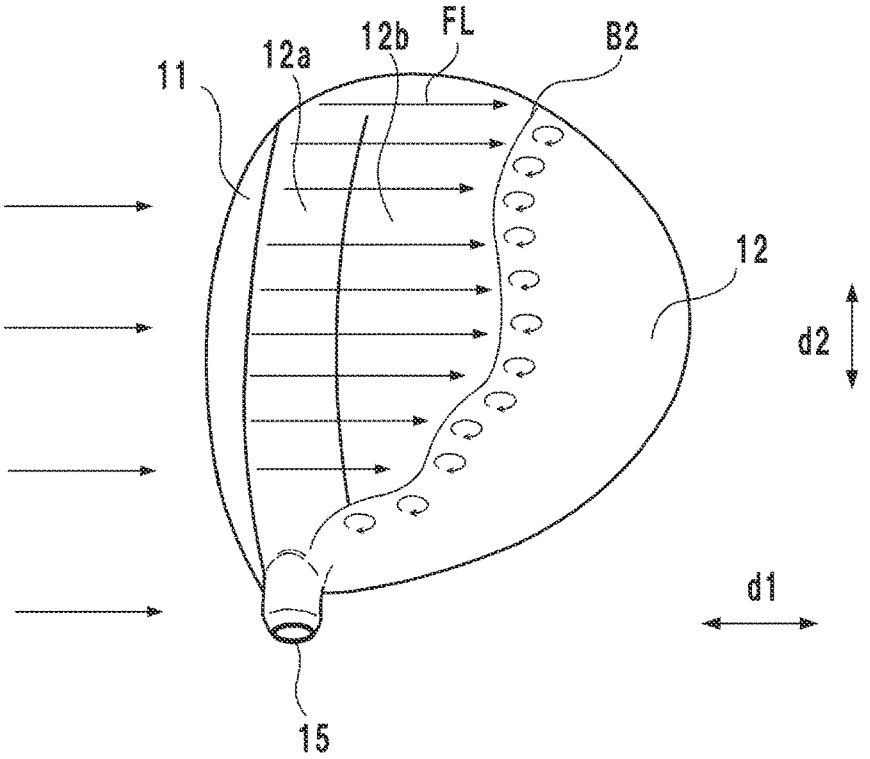

FIG. 5B is an explanatory view showing the relationship between the flow FL and the separation position of an air current to the crown portion 12 including the first protruding portion 12*a* and the second protruding portion 12*b* according to this embodiment. A position where separation starts on the crown portion 12 is indicated by a solid line B2. In this embodiment, the second protruding portion 12*b* makes the flow FL of the air current readily move along the crown portion 12 and moves the separation position of the air current to the back side, as can be seen. As a result, the air resistance to the golf club head 10 can be reduced.

As described above, according to the golf club head 10 of this embodiment, the position where the separation of the air current occurs can be moved to the back side. The separation of the air current on the crown thus delays, and the air resistance to the golf club head can be reduced. In addition, since the connection portion 12*c* between the first protruding portion 12*a* and the second protruding portion 12*b* runs across the crown portion 12, the air current flowing on the surface of the crown portion 12 can be made to hardly separate in the toe-heel direction d2 as a whole.

<Other Embodiments>

In the above embodiment, one protruding portion is adjacent to the first protruding portion 12*a*. However, a plurality of protruding portions may be adjacent to the first protruding portion 12*a*. At this time, the protruding height of each of the plurality of protruding portions adjacent on the back side of the first protruding portion 12*a* is set to be larger than that of a protruding portion adjacent on the face side. The protruding portions may be arranged only near the center of the golf club head 10 in the toe-heel direction d2 or only near the two ends.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-218750, filed Nov. 6, 2015, which is hereby incorporated by reference herein in its entirety.

What is claimed is:

1. A golf club head comprising a crown portion and a face portion, wherein the crown portion includes a first protruding portion arranged on a side of the face portion and extending from an upper end of the face portion to a back side, a second protruding portion arranged on the back side to be adjacent to the first protruding portion, and a valley portion formed where the first and second protruding portions are connected to one another, the second protruding portion has a convex-curved outer surface extending from the valley portion to a back side end of the crown portion, a width of the first protruding portion in a face-back direction on a plane passing through a face center of the face portion and extending in a vertical direction is smaller than a width of the second protruding portion in the face-back direction, and a protruding height of the second protruding portion is larger than a protruding height of the first protruding portion, wherein curved outer surfaces of the first and second protruding portions abut to form an inflection at the valley portion.

2. The golf club head according to claim 1, wherein the first protruding portion and the second protruding portion are arranged to extend in a toe-heel direction perpendicular to the plane.

3. The golf club head according to claim 1, wherein the first protruding portion includes one end and other end in the face-back direction, the one end is connected to the upper end of the face portion, the other end is connected to the second protruding portion, and the protruding height increases from the one end to the other end.

4. The golf club head according to claim 1, wherein the second protruding portion includes one end and other end in the face-back direction, the one end is connected to the first protruding portion, the other end is connected to a side portion on the back side, and the protruding height increases and then decreases from the one end to the other end.

5. The golf club head according to claim 1, wherein the width of the first protruding portion in the face-back direction on the plane is 20% (inclusive) to 40% (inclusive) of a width of the head in the face-back direction.

6. The golf club head according to claim 1, wherein a boundary line between the first protruding portion and the second protruding portion has a length in a toe-heel direction, and the length is 50% (inclusive) to 100% (inclusive) of a width of the enter head in the toe-heel direction.

7. The golf club head according to claim 1, wherein a lowest point of the valley is lower than the protruding height of the first protruding portion and the protruding height of the second protruding portion.

8. The golf club head according to claim 1, wherein the second protruding portion includes an apex in the crown portion.

9. A golf club head comprising a crown portion and a face portion, wherein the crown portion includes a first convex surface arranged on a side of the face portion and extending in a face-back direction, a second convex surface arranged on a back side to be adjacent to the first convex surface, and an inflection at a valley portion formed between the first and second convex surfaces, the second convex surface has a convex-curved outer surface extending from the valley portion to a back side end of the crown portion, a width of the first convex surface in the face-back direction on a plane passing through a face center of the face portion and extending in a vertical direction is smaller than a width of the second convex surface in the face-back direction, and a protruding height of the second convex surface is larger than a protruding height of the first convex surface, wherein the valley portion is formed of curved surfaces.

10. The golf club head according to claim 9, wherein a lowest point of the valley is lower than the protruding height of the first convex surface and the protruding height of the second convex surface.

11. The golf club head according to claim 9, wherein the second convex surface includes an apex in the crown portion.

* * * * *